US006268315B1

(12) United States Patent
Baca et al.

(10) Patent No.: US 6,268,315 B1
(45) **Date of Patent: *Jul. 31, 2001**

(54) CONDITIONING OIL FOR BOWLING LANES

(75) Inventors: Joseph Samuel Baca, Stockton; Hermas N. Beaudet, Pacheco, both of CA (US)

(73) Assignee: Lane Masters, Inc., Stockton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/571,494

(22) Filed: May 15, 2000

(51) Int. Cl.[7] ..... C10M 101/00

(52) U.S. Cl. ..... 508/208; 508/371; 508/372; 508/389; 508/390; 508/547; 508/562; 508/583; 508/591

(58) Field of Search ..... 508/208, 591

(56) References Cited

U.S. PATENT DOCUMENTS

| | | | |
|---|---|---|---|
| 3,589,923 | 6/1971 | Stein | 106/285 |
| 3,932,043 | 1/1976 | Joffre | 401/137 |
| 4,478,730 | 10/1984 | O'Connor | 508/487 |
| 5,534,173 | 7/1996 | Faber et al. | 508/203 |
| 5,883,055 | 3/1999 | Baca | 508/206 |
| 6,063,261 | 5/2000 | Baca | 208/18 |

*Primary Examiner*—Ellen M. McAvoy
(74) *Attorney, Agent, or Firm*—Flehr Hohbach Test Albritton & Herbert LLP

(57) ABSTRACT

Conditioning oil for use on bowling lanes. The oil contains a mixture of mineral oil, a leveling agent, and an antistatic agent. The mineral oil is a combination of paraffin and petroleum based mineral oils and/or a polyalphaolefin synthetic oil, and in some embodiments, the mixture also includes a flow agent, a fluorescent whitening agent, a lubricity agent, and a surfactant.

35 Claims, No Drawings

CONDITIONING OIL FOR BOWLING LANES

RELATED PATENTS

This invention is related to the subject matter of U.S. Pat. Nos. 5,883,055 and 6,063,261.

BACKGROUND OF THE INVENTION

1. Field of the Invention

This invention pertains generally to the preparation and care of bowling lanes and, more particularly, to a conditioning oil for use on bowling lanes.

2. Related Art

Conditioning oil is applied to the surface of bowling lanes to provide proper ball action. The oil is applied to the head and center portions of each lane so that the ball will slide over them and then grip the surface as it approaches the pin deck.

The oil has a significant effect on the manner in which the ball travels down the lane, and proper oiling is very important for consistent action and scoring. If the oil gets picked up by the ball and carried down the lane or is pushed down the lane ahead of the ball, the oil can get onto the pin deck where it can cause the pins to slide around instead of falling. If the oil gets into the ball return machine, it can gum the machine up and interfere with its operation.

With too little oil, the ball does not slide far enough before taking hold of the lane, which results in too much hook or hooking or in an unpredictable and uncontrollable manner.

In addition, channels can form in the oil where the balls have travelled, causing uneven oil patterns and further inconsistencies in the manner in which the balls behave on the lane.

OBJECTS AND SUMMARY OF THE INVENTION

It is in general an object of the invention to provide a new and improved conditioning oil for use on bowling lanes.

Another object of the invention is to provide a conditioning oil of the above character which substantially eliminates the problems associated with the lane oils of the prior art.

These and other objects are achieved in accordance with the invention by providing a lane conditioning oil which contains a mixture of mineral oil, a leveling agent, and an antistatic agent. The mineral oil is a combination of paraffin and petroleum based mineral oils and/or a polyalphaolefin synthetic oil, and in some embodiments, the mixture also includes a flow agent, a fluorescent whitening agent, a lubricity agent, and a surfactant.

DETAILED DESCRIPTION

The major component of the conditioning oil is the oil itself which can be a combination of a paraffinic based mineral oil, a petroleum based mineral oil and/or a synthetic oil.

A high grade paraffin mineral oil which is crystal clear in appearance can be used as the base for the mixture. It comprises about 60 to 85 percent of the mineral oil mixture. The paraffin oil is refined to eliminate long carbon chains and preferably has no more than about 20 to 30 carbon atoms per molecule.

A petroleum based mineral oil can be combined with the paraffin oil so as to constitute about 10 to 20 percent of the mixture. The petroleum based oil has a higher viscosity than the paraffin based oil and tends to adhere to the lanes somewhat better than the lighter paraffin oil. That is an important characteristic in preventing the oil from carrying down the lane with the ball. The heavier oil also provides better ball control and better ball action on the portion of the lane to which the oil is applied.

Synthetic oils such as polyalphaolefins (PAOs) can likewise be used as the base for the mixture and can comprise about 60 to 85 percent of it. The PAO preferably has a high purity, a narrow molecular weight distribution, a minimally long carbon chain (no more than about 24 to 36 carbon atoms per molecule), crystal clarity and is wax free, with a viscosity on the order of 1.5 to 9 centistoke. Such oils are based on decene, a common building block for synthetic lubricant stocks. PAOs such as Chevron Chemical's SYNFLUIDS and Amoco's DURASYNS have been found to impart very desirable lubricity properties to the lane oil.

For greater quantities of oil and stronger oil ratio patterns (i.e., top hat condition), lower viscosity oils can be employed. For lower amounts of lane dressing and weaker oil pattern ratios, higher viscosities are used.

With some of the machines which are used for applying the oil to the lanes, it is desirable to include a flow agent in the mixture. Such machines have a wick of felt material which carries the oil from a trough to the roller which applies it to the lanes. The flow agent thins the oil so that it is better able to travel up the wick and onto the roller. Once the oil has been applied to the lanes, the flow agent evaporates or "flashes off" and does not affect the performance of the oil. Newer felt materials provide a better wicking action and may be able to carry the oil without the flow agent, in which case the flow agent can be eliminated from the mixture. The amount of flow agent which is used is on the order of 0 to about 8 percent (by volume) of the mixture. Suitable flow agents include xylene, toluene, isopropyl alcohol, n-propyl alcohol, and acetylenic alcohol.

Lane conditioning oils based on PAOs have been found to give enhanced flow through the wicks and orifices of application machines, as compared with conditioning oils which are based on mineral oils. In addition, lane oils formulated with PAOs provide an improved viscosity index as compared with oils based on mineral oil. This means that when the application temperature decreases, the viscosity of the oil does not in crease as much, which is a distinct advantage in cold weather.

A fluorescent whitening agent is included in the mixture in order to meet the requirements of the American Bowling Congress. That agent enables lane men to check the thickness of the oil which has been applied to the lanes and to insure that it is within prescribed standards. The whitening agent constitutes about 0.03 percent (by volume) of the mixture.

In some applications, a lubricity agent composed of various hydrocarbon lubrication oils is included in the mixture to help the ball hold the lane better and to react better. In many applications, the lubricity agent is not required, in which case it can be omitted from the mixture. When included, the lubricity agent constitutes about 0.1 to 2.0 percent of the mixture.

It has been found that superior lubricity is provided by liquid polyethylene, glyceryl monoesters such as Pationic 907 from American Ingredients Company, and a monoglyceride derived from vegetable oils.

Other suitable lubricity agents include organic fatty acids such as $C_{16}$ to $C_{24}$ saturated fatty acids and monounsaturated fatty acids (e.g., palmitic, stearic, and oleic);

fatty saturated and unsaturated amides, including $C_{18}$ to $C_{22}$ fatty saturated and unsaturated primary amides (e.g., stearamide, oleamide and erucamide), secondary fatty amides (e.g., stearyl erucamide and stearyl stearamide), and ethylene bisamides (e.g., N,N'-ethylene bistearamide and N,N'-ethylene bisoleamide); phosphoric acid esters such as tricresyl phosphate, cresyl diphenyl phosphate, and alkyl organic phosphate ester acid; polytetrafluoroethylene (PTFE or Teflon®) beads; polyethylene waxes; wax dispersions from PTFE and polyethylene; polyether-modified silicones; and zinc dithiophosphate.

A leveling agent is included in the mixture so that the oil on the lane will close behind the ball and remain level, rather than forming channels which could affect the action of subsequent balls. If the oil did not flow back, balls would begin hooking where they used to slide, and the ball action would be inconsistent. The leveling agent comprises on the order of about 0.1 to 2.0 percent (by volume) of the mixture. If too much leveling agent is used, the oil will tend to build up and splatter in front of the ball, thereby producing an undesirable effect of carrying the oil down the bowling lane.

Suitable leveling agents include polydimethyl polysiloxanes such as polyether modified dimethyl polysiloxane copolymers; calcium alkaryl sulfonates, either petroleum derived or synthetic; acetylenic diols such as Air Products & Chemicals, Inc. Surfynol HS-30; acetylenic alcohols such as Air Products & Chemicals, Inc. Surfynol 61; silicone glycol copolymers (e.g., ethyl acrylate); and acrylic copolymers (e.g., ethyl acrylate/2-ethylhexyl acrylate copolymer solution in xylene).

Although the higher viscosity petroleum based oils tend to give better adherence to lane surfaces than the paraffin based oils, this effect can be enhanced through the use of certain surfactants and wetting agents with either the paraffin based oils or the PAO compositions. Suitable surfactants include calcium aryl sulfonates such as K-Sperse 131 from King Industries, fluorosurfactants such as 3M's Fluorads or DuPont's Zonyls. It has also been found that acetylenic diols and alcohols marketed by Air Products under the names Surfynol HS-30 additive and Surfynol 61 surfactant have a very pronounced leveling action and also tend to minimize carry-down of the oil.

An antistatic agent is included in the mixture to prevent static buildup which can cause oil and dirt to adhere to the ball and can also cause the oil to be carried down the lane. The static tends to develop as the ball, which is typically made of a resin based material, travels over the oil and wood interface at the surface of the lane. The oil which adheres to the ball is carried down the lane, dust particles in the air are attracted to the ball, and the ball action becomes sluggish. By including the antistatic agent in the mixture, these problems are greatly reduced. The antistatic agent comprises about 0.1 to 3.0 percent (by volume) of the mixture.

Suitable antistatic agents include quaternary ammonium chlorides including alkyl benzyl ammonium chlorides and ethoxylated tertiary amine methyl ammonium chlorides; diammonium ethosulfates; ethoxylated alkyl amines (propyl to octadecyl, i.e. $C_3$ to $C_{18}$), soya and/or tallow amines; ethoxylated amine oxides such as ethoxylated alkyl oxypropyl amine oxides (methyl to $C_{18}$); trimethyl alkyl ammonium chlorides such as cetyl trimethyl ammonium chlorides; a quaternary compound which is a reaction product of an aliphatic tertiary amine and methyl chloride; an ethoxylated amine comprising a fatty amine reacted with ethylene oxide; and an alkylated phenol such as 2,6-dibutyl-4-nonyl phenol.

The following examples are formulations for several specific embodiments of lane conditioning oil in accordance the invention.

EXAMPLE 1

Polyalphaolefin, 2.5 centistoke (440.00 lbs)

Hydrotreated light distillate oil (350.00 lbs)

Fluorescent whitening agent (0.25 lbs)

Xylene (5.00 lbs)

Antistatic compound
- Alkylated phenol (3.12 lbs)
- Ethoxylated amine (1.56 lbs)
- Quaternary amine (1.56 lbs)

Lubricity agent
- Glyceryl monostearate (6.25 lbs)

Leveling Agent/Surfactant
- Calcium aryl sulfonate (3.50 lbs)

All components are blended together thoroughly, e.g. by high speed blending and in-line agitation for at least 5 hours. Thorough blending is important for product uniformity and performance consistency.

EXAMPLE 2

Polyalphaolefin, 8 centistoke (546.00 lbs)

Paraffin mineral oil (234.00 lbs)

Fluorescent whitening agent (0.25 lbs)

Xylene (6.20 lbs)

Antistatic agent
- Diammonium ethosulfate (2.25 lbs)

Lubricity agent
- Liquid polyethylene (4.65 lbs)

Leveling Agent/Surfactant
- Long chain acetylenic alcohol (4.00 lbs)

As in the previous example, all components are blended together thoroughly, e.g. by high speed blending and in-line agitation for at least 5 hours.

EXAMPLE 3

Paraffin mineral oil (397.0 gals)

Petroleum mineral oil (88.0 gals)

Isopropyl alcohol (76.4 lbs)

Fluorescent whitening agent (608 gms)

Lubricity agents
- Solvent dewaxed heavy paraffin petroleum distillate (420 gms)
- Hydro treated heavy napthenic petroleum distillate (161 gms)
- Calcium alkaryl sulfonate (19.4 gms)
- Amine grafted ethylene/propylene copolymer (25.8 gms)
- Zinc Dithiopthsphate (19.4 gms)

Leveling agent
- Alkyl siloxane (11.6 lbs)

Antistatic compound
- Quaternary compound (1.8 lbs)
- Ethoxylated amine (1.8 lbs)
- Alkylated phenol (3.5 lbs)

As in the previous examples, all components are blended together thoroughly, e.g. by high speed blending and in-line agitation for at least 5 hours.

EXAMPLE 4

A similar formulation with a different antistatic agent contains the following mixture of ingredients:

Paraffin mineral oil (397.0 gals)

Petroleum mineral oil (88.0 gals)

Isopropyl alcohol (76.4 lbs)

Fluorescent whitening agent (608 gms)

Lubricity agents

- Solvent dewaxed heavy paraffin petroleum distillate (420 gms)
- Hydro treated heavy napthenic petroleum distillate (161 gms)
- Calcium alkaryl sulfonate (19.4 gms)
- Amine grafted ethylene/propylene copolymer (25.8 gms)
- Zinc Dithiophosphate (19.4 gms)

Leveling agent

- Alkyl siloxane (11.63 lbs)

Antistatic Agent

- Quaternary ammonium chloride (3.87 lbs)

As in the previous example, all components are blended together thoroughly, e.g. by high speed blending and in-line agitation for at least 5 hours.

EXAMPLE 5

A 500 gallon batch of the conditioning oil made in accordance with a previously preferred formulation contains the following mixture of ingredients:

Paraffin mineral oil (402.77 gals)

Petroleum mineral oil (61.96 gals)

Isopropyl alcohol (30.98 gals)

Fluorescent whitening agent (0.14 gal)

Lubricity agents

- Solvent dewaxed heavy paraffinic petroleum distillate (0.97 gal)
- Hydrotreated heavy napthenic petroleum distillate (0.31 gal)
- Calcium alkaryl sulfonate (0.03 gal)
- Amine grafted ethylene/propylene copolymer (0.04 gal)
- Zinc Dithiophosphate (0.03 gal)

Leveling agent

- Alkylsiloxane (1.3 gals)

Antistatic Agents

- Chloro-propyl-trimethoxy-silane (0.69 gal)
- Methyl alcohol (0.69 gal)

All components are blended together thoroughly, e.g. by high speed agitation or in-line blending for a minimum of 45 minutes.

The invention has a number of important features and advantages. It provides consistent ball action and scoring, which are critical to good bowling. The ball slides down the lane without developing channels and without carrying the oil with it. Static buildup is eliminated, and there is a reduced tendency for dirt and oil to adhere to the ball. This results not only in more consistent bowling but also in a significant increase in the cleanliness of the lanes. In addition, since the oil remains in place better than other oils, the time between oilings is reduced, and that has the additional advantages of reducing not only the cost of the materials and labor involved but also the time the lanes are out of service during conditioning.

It is apparent from the foregoing that a new and improved conditioning oil for use on bowling lanes has been provided. While only certain presently preferred embodiments have been described in detail, as will be apparent to those familiar with the art, certain changes and modifications can be made without departing from the scope of the invention as defined by the following claims.

What is claimed is:

1. A conditioning oil for use on bowling lanes, comprising: a mixture of a polyalphaolefin synthetic oil, mineral oil, a leveling agent, and an antistatic agent.

2. The conditioning oil of claim 1 wherein the mixture further includes a fluorescent whitening agent.

3. The conditioning oil of claim 1 further including a lubricity agent.

4. The conditioning oil of claim 1 further including a surfactant.

5. A conditioning oil for use on bowling lanes, comprising: a mixture of a polyalphaolefin synthetic oil, a hydrotreated light distillate oil, a fluorescent whitening agent, xylene, alkylated phenol, ethoxylated amine, quaternary amine, glyceryl monostearate, and calcium aryl sulfonate.

6. The conditioning oil of claim 5 wherein the mixture comprises 440 parts polyalphaolefin synthetic oil, 350 parts hydrotreated light distillate oil, 0.25 parts fluorescent whitening agent, 5.0 parts xylene, 3.12 parts alkylated phenol, 1.56 parts ethoxylated amine, 1.56 parts quaternary amine, 6.25 parts glyceryl monostearate, and 3.50 parts calcium aryl sulfonate.

7. The conditioning oil of claim 5 wherein the polyalphaolefin has a viscosity of about 2.5 centistoke at ambient temperature.

8. A conditioning oil for use on bowling lanes, comprising: a mixture of a polyalphaolefin synthetic oil, a paraffin mineral oil, a leveling agent and antistatic agent.

9. The conditioning oil of claim 8 wherein the mixture further includes a fluorescent whitening agent.

10. The conditioning oil of claim 8 wherein the mixture further includes a lubricity agent.

11. The conditioning oil of claim 8 wherein the mixture further includes a surfactant.

12. A conditioning oil for use on bowling lanes, comprising: a mixture of a polyalphaolefin synthetic oil, paraffin mineral oil, a fluorescent whitening agent, xylene, diammonium ethosulfate, liquid polyethylene, and a long chain acetylenic alcohol.

13. The conditioning oil of claim 12 wherein the mixture comprises 546 parts polyalphaolefin synthetic oil, 234 parts paraffin mineral oil, 0.25 parts fluorescent whitening agent, 6.20 parts xylene, 2.25 parts diammonium ethosulfate, 4.65 parts liquid polyethylene, and 4.00 parts long chain acetylenic alcohol.

14. The conditioning oil of claim 13 wherein the polyalphaolefin has a viscosity of about 8 centistoke at ambient temperature.

15. A conditioning oil for use on bowling lanes, comprising: a mixture of paraffin mineral oil, petroleum mineral oil, isopropyl alcohol, fluorescent whitening agent, a solvent dewaxed heavy paraffin petroleum distillate, a hydro treated heavy napthenic petroleum distillate, calcium alkaryl sulfonate, an amine grafted ethylene/propylene copolymer, zinc dithiophosphate, alkyl siloxane, a quaternary compound, ethoxylated amine, and alkylated phenol.

16. A conditioning oil for use on bowling lanes, comprising: a mixture of paraffin mineral oil, petroleum mineral oil, isopropyl alcohol, fluorescent whitening agent, a solvent dewaxed heavy paraffin petroleum distillate, a hydro treated heavy napthenic petroleum distillate, calcium alkaryl sulfonate, an amine grafted ethylene/propylene copolymer, zinc dithiophosphate, alkyl siloxane, and quaternary ammonium chloride.

17. A conditioning oil for use on bowling lanes, comprising: a mixture containing an oil selected from the group consisting of a paraffinic based mineral oil, a petroleum based mineral oil, a synthetic oil, and combinations thereof; a leveling agent; a lubricity agent selected from the group consisting of liquid polyethylene, a glyceryl monoester, a monoglyceride derived from vegetable oils, and combinations thereof; and an antistatic agent.

18. The conditioning oil of claim 17 wherein the synthetic oil is a polyalphaolefin.

19. A conditioning oil for use on bowling lanes, comprising a mixture of:

an oil selected from the group consisting of a paraffinic based mineral oil, a petroleum based mineral oil, a synthetic oil, and combinations thereof;

a leveling agent selected from the group consisting of polydimethyl polysiloxanes, calcium alkaryl sulfonates, acetylenic alcohols, silicone glycol copolymers, acrylic copolymers, and combinations thereof; and an antistatic agent.

20. The conditioning oil of claim 19 wherein the polydimethyl polysiloxanes are polyether modified dimethyl polysiloxane copolymers.

21. The conditioning oil of claim 19 wherein the silicone glycol copolymers include ethyl acrylate.

22. The conditioning oil of claim 19 wherein the acrylic copolymers include ethyl acrylate/2-ethylhexyl acrylate copolymer solution in xylene.

23. A conditioning oil for use on bowling lanes, comprising a mixture of:

an oil selected from the group consisting of a paraffinic based mineral oil, a petroleum based mineral oil, a synthetic oil, and combinations thereof;

a leveling agent; and an antistatic agent selected from the group consisting of quaternary ammonium chlorides, diammonium ethosulfates, ethoxylated alkyl amines, trimethyl alkyl ammonium chlorides, a quaternary compound which is a reaction product of an aliphatic tertiary amine and methyl chloride, an ethoxylated amine comprising a fatty amine reacted with ethylene oxide, an alkylated phenol, and combinations thereof.

24. The conditioning oil of claim 23 wherein the quaternary ammonium chlorides include alkyl benzyl ammonium chlorides and ethoxylated tertiary amine methyl ammonium chlorides.

25. The conditioning oil of claim 23 wherein the ethoxylated alkyl amines include $C_3$ to $C_{18}$ amines, soya and tallow amines.

26. The conditioning oil of claim 23 wherein the trimethyl alkyl ammonium chlorides include cetyl trimethyl ammonium chlorides.

27. A conditioning oil for use on bowling lanes, comprising a mixture of:

an oil selected from the group consisting of a paraffinic based mineral oil, a petroleum based mineral oil, a synthetic oil, and combinations thereof;

a leveling agent;

an antistatic agent; and a lubricity agent selected from the group consisting of organic fatty acids, fatty saturated and unsaturated amides, phosphoric acid esters, polytetrafluoroethylene (PTFE) beads, polyethylene waxes, wax dispersions from PTFE and polyethylene, polyether-modified silicones, zinc dithiophosphate, and combinations thereof.

28. The conditioning oil of claim 27 wherein the organic fatty acids include $C_{16}$ to $C_{24}$ saturated fatty acids and mono-unsaturated fatty acids.

29. The conditioning oil of claim 27 wherein the fatty acids include palmitic, stearic, and oleic fatty acids.

30. The conditioning oil of claim 27 wherein the fatty saturated and unsaturated amides include $C_{18}$ to $C_{22}$ fatty saturated and unsaturated primary amides, secondary fatty amides, and ethylene bisamides.

31. The conditioning oil of claim 30 wherein the primary amides include stearamide, oleamide and erucamide.

32. The conditioning oil of claim 30 wherein the secondary fatty amides include stearyl erucamide and stearyl stearamide.

33. The conditioning oil of claim 30 wherein the ethylene bisamides include N,N'-ethylene bistearamide and N,N'-ethylene bisoleamide.

34. The conditioning oil of claim 27 wherein the phosphoric acid esters include tricresyl phosphate, cresyl diphenyl phosphate, and alkyl organic phosphate ester acid.

35. A conditioning oil for use on bowling lanes, comprising a mixture of:

an oil selected from the group consisting of a paraffinic based mineral oil, a petroleum based mineral oil, a synthetic oil, and combinations thereof;

a leveling agent;

an antistatic agent; and a surfactant selected from the group consisting of calcium aryl sulfonates, fluorosurfactants, acetylenic diols and alcohols, and combinations thereof.

* * * * *